US006540222B2

(12) United States Patent
Araki et al.

(10) Patent No.: US 6,540,222 B2
(45) Date of Patent: Apr. 1, 2003

(54) SHEET MATERIAL FEEDING MECHANISM

(75) Inventors: Takao Araki, Kasuga (JP); Yushi Toyomura, Fukuoka (JP); Terumi Tsuda, Fukuoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 100 days.

(21) Appl. No.: 09/748,129

(22) Filed: Dec. 27, 2000

(65) Prior Publication Data

US 2002/0020957 A1 Feb. 21, 2002

(30) Foreign Application Priority Data

Dec. 28, 1999 (JP) ..... 11-373876
Jan. 18, 2000 (JP) ..... 2000-008905

(51) Int. Cl.[7] ..... B65H 3/52

(52) U.S. Cl. ..... 271/122; 271/10.11; 271/121; 271/125; 271/262; 271/263

(58) Field of Search ..... 271/262, 263, 271/265.04, 10.11, 121, 122, 125

(56) References Cited

U.S. PATENT DOCUMENTS 5,145,164 A * 9/1992 Kan ..... 271/170
6,364,556 B1 * 4/2002 Barbera et al. ..... 271/262

FOREIGN PATENT DOCUMENTS

| | | |
|---|---|---|
| JP | 1115647 | 8/1989 |
| JP | 4129952 | 4/1992 |

* cited by examiner

*Primary Examiner*—Donald P. Walsh
*Assistant Examiner*—Jonathan R Miller
(74) *Attorney, Agent, or Firm*—Stevens, Davis, Miller & Mosher, LLP

(57) ABSTRACT

In order to securely prevent or detect overlap feeding of sheet materials, there is provided a sheet material feeding mechanism which deforms the sheet materials on a feeding line so as to form a gap between the overlapping sheet materials which firmly cling to each other. For preventing the overlap feeding of the sheets, the drive relationship between a feeding roller and a pair of a parting roller and a retarding roller located on the downstream side from the feeding roller is optimized to form the gap between the sheet materials. Further, for detecting the overlap feeding of the sheets, bending correction ribs are provided on guide plates formed on the upper and lower sides of the feeding line of the sheet materials so as to deform the sheet materials fed in the overlapping condition, thereby the gap is formed between the overlapping sheets.

3 Claims, 11 Drawing Sheets

SHEET MATERIAL FEEDING MECHANISM

FIELD OF THE INVENTION

The present invention relates to a sheet material feeding mechanism of an image processing apparatus such as an image forming apparatus, e.g. a copying machine, or an image reading apparatus, e.g. an image scanner, and more particularly to a sheet material feeding mechanism of a hopper type or a tray type, which prevents overlap feeding of the sheet materials.

DESCRIPTION OF THE PRIOR ART

Hitherto, in an image processing apparatuses such as a printer or a facsimile machine, there has been widely adopted a method in which sheets of paper are mounted on a tray built in or detachably attached to a main body and automatically fed therefrom. There have been also known an image processing apparatus provided with a hopper type of paper feeding mechanism instead of a tray type of paper feeding mechanism, and a printer provided with both the tray and the hopper as standard equipment.

A tray is formed into a flat container shape, and then the tray suitable to the paper size is installed on an apparatus. The front edge and the back edge of the sheets accommodated in the tray are loosely restrained by a member such as a clamper. On the contrary, the hopper is usually attached to the external of the apparatus, and have a basic construction in which sheets are simply placed on the hopper equipped with a pair of guides by which the position of the sheets can be adjusted in accordance with the width of the sheets. Such a hopper type paper feeding mechanism is widely used for an image scanner which reads a large volume of documents different in size, paper quality, and thickness.

It is very important for an image processing apparatus to prevent the sheets of paper fed from a tray or a hopper from overlapping each other, namely to prevent overlap feeding. The overlap feeding frequently causes a paper jam, and markedly deteriorates the workability.

Accordingly, there has been generally adopted a paper feeding mechanism comprising a parting roller and a retarding roller disposed immediately downstream from a tray or a hopper equipped with a feeding roller for picking up and feeding the top one of stacked sheets so as to prevent the overlap feeding.

FIG. 11A and FIG. 11B schematically show the essential section of a conventional paper feeding mechanism employing a parting roller and a retarding roller.

Referring to FIG. 11A, a feeding roller 52 is disposed on a stack of sheets P mounted on a hopper 51, and a parting roller 53 and a retarding roller 54 are provided on the downstream side of the feeding roller 52. The parting roller 53 comes in contact with the top surface of the sheet P fed by the feeding roller 52, and the retarding roller 54 comes in contact with the bottom surface of the sheet P so that the sheet P is nipped therebetween. When the paper feeding mechanism is operated, the feeding roller 52 and the parting roller 53 are respectively driven to rotate in the same direction, as indicated by the arrows in the drawings. The retarding roller 54 is mounted on a main shaft (not shown) driven to rotate in the direction as indicated by the arrow in the drawings via a torque limiter (not shown), and usually driven to rotate in the direction as indicated by the arrow in the drawing, namely, in the direction to push the sheet P back to the hopper 51. The retarding roller 54 is elastically urged against the parting roller 53 and can be adjusted by adapting the urging force to the quality or thickness of the sheet P.

In the feeding mechanism, when only one sheet P is fed from the hopper 51 and nipped between the parting roller 53 and the retarding roller 54, the retarding roller 54 receives the rotational torque of the parting roller 53, and thereby is driven to rotate in the direction in which the sheet P is fed. On the contrary, when two or more sheets P are fed and nipped, the retarding roller 54 puts back the lower sheet P toward the hopper 51 since the rotation is maintained in the direction as indicated by the arrow in the drawing based on the mutual relationship between the built-in torque limiter and the urging force applied to the parting roller 53, so that the overlap feeding is prevented.

The hopper 51 is urged toward the feeding roller 52 by a spring (not shown) or the like, and set so that the contact pressure between the peripheral surface of the feeding roller-52 and the top one of the stacked sheets P is maintained to be substantially constant. When the feeding roller 52 is driven to rotate and the top one P-1 of sheets is picked up, the sheet P-1 is nipped between the parting roller 53 and the retarding roller 54 as shown in FIG. 11A, and quickly fed.

Recently, an ultrasonic overlap feeding detection mechanism has been disseminated for prevent the overlap feeding of the sheets. As one example of using the ultrasonic wave, there is a mechanism disclosed in JP-A-4-129952, of which the schematic diagrams are presented in FIG. 12A and FIG. 12B.

As shown in FIG. 12A, the overlap feeding detection mechanism is provided with an ultrasonic transmitter 153 and an ultrasonic receiver 154 disposed across a feeding line of bank notes 151 and 152, and further provided with a waveform analyzer 155 to which the output signals of the ultrasonic receiver 54 are inputted.

An ultrasonic wave transmitted from the ultrasonic transmitter 153 passes through the bank note 151 and is received by the ultrasonic receiver 154 as an ultrasonic signal. The received ultrasonic signal is then supplied in the form of an output voltage to the waveform analyzer 155 and analyzed as an output signal as shown in FIG. 12B. The ultrasonic wave from the ultrasonic transmitter 153 attenuates when passing through the bank note 151, and the attenuated signal is received by the ultrasonic receiver 154. When a portion of an area A corresponding to one bank note 151 passes, an output voltage within the area A shown in FIG. 12B is analyzed, so that the voltage is set as a reference output signal. On the contrary, when a portion of an area B in which the bank note 152 overlaps on the bank note 151 passes, the volume of the attenuation of the ultrasonic wave increases, so that the output signal in the area B shown in FIG. 12B is analyzed. Accordingly, the overlap feeding of the bank notes 151 and 152 is detected by detecting the difference between the reference output signal and the attenuated output signal.

That is, in the overlap feeding detection of the sheets using the ultrasonic wave, a receiving intensity level obtained when one sheet passes is beforehand set as a reference level, and if the receiving intensity level of an actually detected signal is lower than the reference value, the overlap feeding is also detected.

Such overlap feeding detection of the sheets using the ultrasonic waves is adopted, in the same manner, in the fields of preventing the overlap feeding of the sheets in a printer, a copying machine and a printing machine, as shown in JP-A-1-115647, for example.

SUMMARY OF THE INVENTION

The sheets of paper mounted on the hopper or the tray are generally used as it is after drawn out from a package, so that the sheets of paper remain highly adhering to each other. In addition, since the sheets of paper are subjected to the urging force of the hopper against the feeding roller, when the sheet P is picked up by the feeding roller 52, it sometimes happens that three sheets of paper P-1, P-2 and P-3 for example, or more sheets of paper are simultaneously fed to the nipping portion between the parting roller 53 and the retarding roller 54 due to the mutual contact friction therebetween, as shown in FIG. 11B.

In such a case, according to the conventional paper feeding mechanism, the parting roller 53 and the retarding roller 54 part the sheets of paper P-1, p-2 and P-3 to allow only the uppermost sheet of paper P-1 to pass, thereby the overlap feeding is prevented. However, if the adhesion among the three sheets of paper P-1, p-2 and P-3 is strong, the sheets of paper P-1, p-2 and P-3 pass through the nipping portion between the parting roller 53 and the retarding roller 54, resulting in the overlap feeding being caused. The problem in the conventional paper feeding mechanism comes from the fact that the feeding roller rotates in synchronization with the parting roller and the retarding roller downstream from the feeding roller, so that the sheets of paper remain adhering closely to each other.

While the conventional ultrasonic overlap feeding detection mechanism is disposed in the vicinity of a paper discharging port of the hopper or the tray to detect the overlap feeding, if the upper and lower overlapping sheets of paper adhere closely to each other, the degree of change in an ultrasonic signal decreases or the attenuation of the signal decreases, so that the overlap feeding is readily missed. As a result of this, there is caused a problem that the reliability of the detection of the overlap feeding deteriorates especially when thinner sheets of paper such as a payment slip are fed out.

Accordingly, it is an object of the present invention to provide a sheet material feeding mechanism capable of solving the problem described above.

It is another object of the present invention to provide a sheet material feeding mechanism capable of reliably preventing the overlap feeding of sheet materials by optimizing the drive relationship between a feeding roller of a sheet material, and a parting roller and a retarding roller disposed downstream from the feeding roller.

It is yet another object of the present invention to provide a overlap feeding detection mechanism improved in accuracy of the ultrasonic overlap feeding detection using a ultrasonic wave by deflecting sheet materials to forcibly form an air layer between the sheet materials even if the sheet materials are fed overlapping each other.

According to the present invention, there is provided a sheet material feeding mechanism used for an image processing apparatus, which feeds a sheet material from a stack of sheet materials mounted on a hopper or a tray to an image processing system, wherein a sheet material is deflected on a feeding line so as to form a gap between the sheet materials which are fed in a closely overlap condition.

According to one aspect of the present invention, the sheet material feeding mechanism may include a feeding roller for picking up a sheet material from the hopper or the tray and feeding the sheet material toward the image processing system, and a pair of rollers comprising a parting roller and a retarding roller which are disposed at an entrance of the image processing system downstream from the feeding roller for preventing the overlap feeding, wherein the feeding roller and the pair of rollers are controlled so that the feeding roller rotates to feed a sheet material from the hopper or the tray while the pair of rollers stops, and after the front end of the sheet material reaches a nipping portion between the pair of rollers, at least the parting roller of the pair starts to rotate in the sheet material feeding direction.

By this arrangement, when a plurality of sheet materials are picked up from a hopper or a tray, and the front edges of the sheet materials reach the nipping portion between the parting roller and the retarding roller so as to be received thereby, the uppermost sheet material is still subjected to frictional feeding by continuing the rotation of the feeding roller. Thus, the uppermost sheet material is deflected (deformed) upward so as to be parted from the lower sheet material. At this timing, the parting roller is driven to rotate so as to feed only the uppermost sheet material to the downstream side, thereby the overlap feeding in the image processing system is prevented.

Alternatively, according to another aspect of the present invention, the sheet material feeding mechanism may include an overlap feeding detection mechanism comprising an ultrasonic transmitting means and an ultrasonic receiving means which are disposed opposite to each other across the sheet material feeding line, the transmitting means transmitting an ultrasonic wave, the receiving means receiving the ultrasonic wave which has passed through a sheet material and is attenuated thereby, wherein an output value of the attenuated ultrasonic wave is compared with a predetermined reference value for detecting the overlap feeding of the sheet materials. The overlap feeding detection mechanism may be provided with a bending correction mechanism for deflecting a sheet material upward or downward on the sheet material feeding line in at least an area including an ultrasonic transmitting path.

By this arrangement, it is possible to form an air layer between the sheet materials to increase the attenuation degree of the output waveform of an ultrasonic wave transmitted from the ultrasonic transmitting means to the receiving means, so that highly accurate detection can be accomplished.

The sheet material feeding mechanism may include a pair of guide plates formed on the upper and lower sides of the sheet material feeding line, wherein the bending correction mechanism is at least one pair of bending correction ribs disposed on each guide plate across the ultrasonic transmitting path for pushing up or down the sheet materials. This arrangement achieves, only by providing the guide plates with the bending correction ribs, highly accurate overlap feeding detection.

Furthermore, the bending correction ribs disposed on each guide plate may be arranged in parallel with each other in the sheet material feeding mechanism.

Alternatively, the bending correction ribs disposed on the lower guide plate may be disposed so that the distance therebetween gradually opens toward the sheet material feeding direction. This arrangement makes it possible to provide highly accurate overlap feeding detection by prompting the lowermost sheet of the overlapping sheets of paper to deform.

Alternatively, the bending correction ribs disposed on the upper guide plate may be disposed so that the distance therebetween gradually closes toward the sheet material feeding direction.

Alternatively, the friction coefficient between the bending correction ribs disposed on the lower guide plate and the sheet material may be larger than that between the bending correction ribs disposed on the upper guide plate and the sheet material. By increasing the resistance against the lowermost sheet of the overlapping sheets of paper, it possible to further enhance the deformation of the overlapping sheets of paper.

Embodiments in accordance with the present invention will be described in conjunction with the accompanying drawings.

DESCRIPTION OF THE PREFERRED EMBODIMENTS

An embodiment in accordance with the present invention will be described, using an example of an image scanner for reading images from documents and filing the read images electronically.

Figure 1:
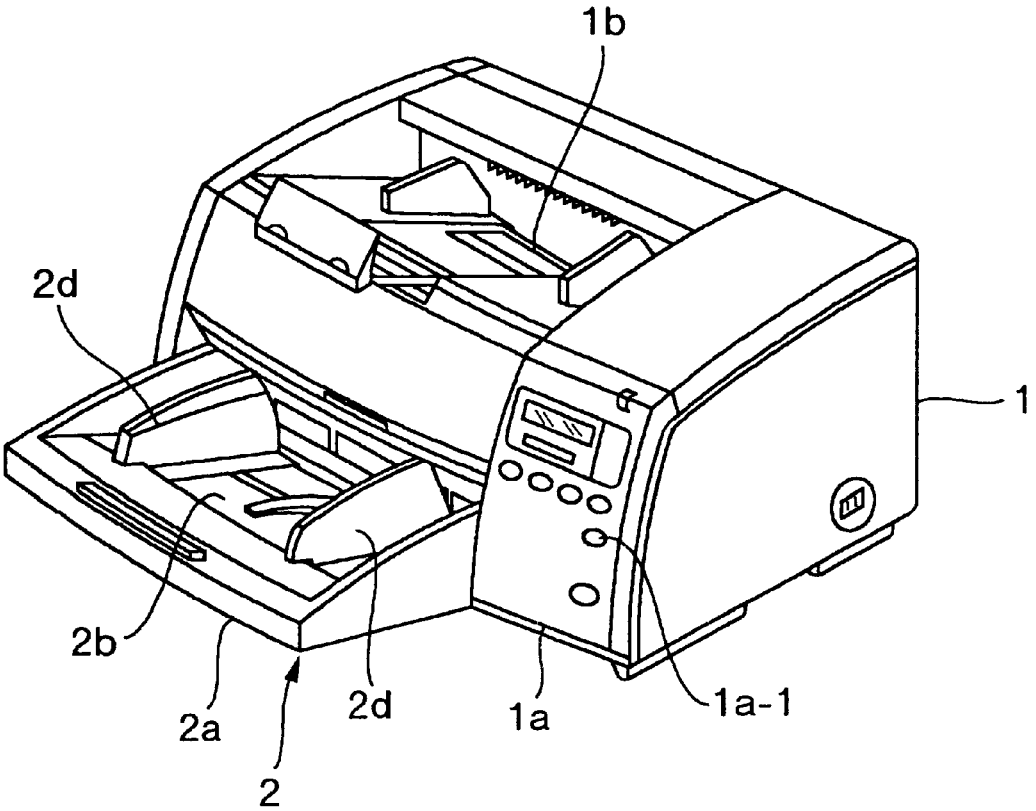
FIG. 1 is a schematic perspective view of an image scanner equipped with a sheet material feeding mechanism in accordance with the present invention.

Referring to FIG. 1, the image scanner is constructed by a main unit 1 which incorporates an optical reader and a paper feeding passage, and an automatic paper feeder 2 serving as a paper feeding means. The main unit 1 has a control panel la on its front surface, and includes therein a controller (not shown) for controlling all devices. On the top surface of the main unit 1, a recovery tray lb is provided for receiving the sheets of paper on which images have been read and which is fed from the automatic paper feeder 2.

Figure 2:
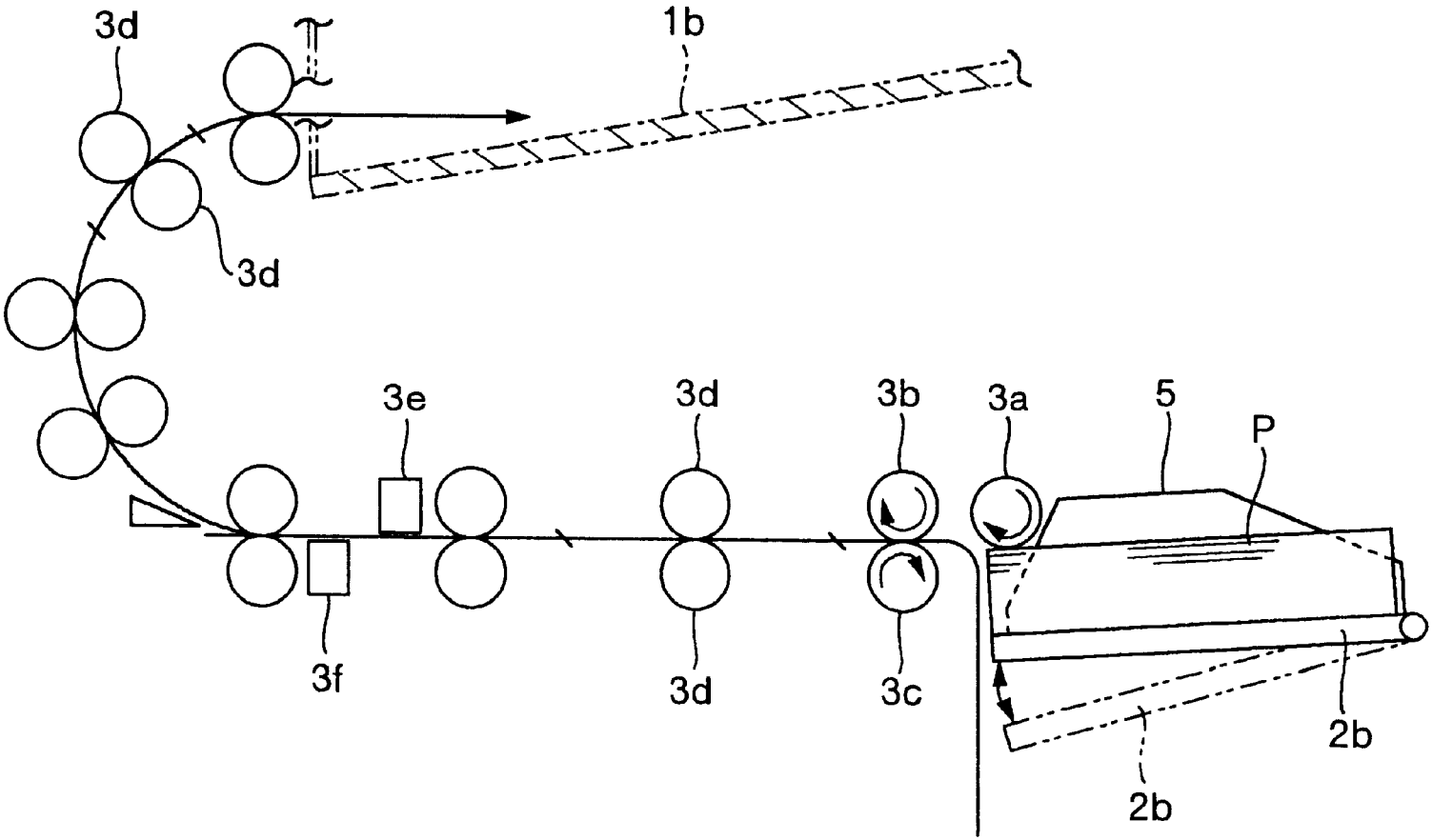
FIG. 2 is a schematic view showing a paper feeding portion from a hopper to a recovery tray in an automatic paper feeding mechanism.

The automatic paper feeder 2 exhibits a hopper function to hold the sheets of paper thereon and feeds it out to the feeding passage in the main unit 1, and a overlap feeding preventing function for the sheets. FIG. 2 is a schematic view showing the section of the automatic paper feeder from the hopper to the paper feeding passage and to the recovery tray.

The automatic feeder 2 has a housing 2*a* and a hopper 2*b* installed in the housing 2*a* so as to be able to rotate upward and downward. The hopper 2*b* is consecutively connected with a motor (not shown) and driven by the motor so as to rotate and bias the paper P upward until it comes in contact with a feeding roller 3*a* as shown in FIG. 2. Furthermore, the hopper 2*b* is provided with a pair of guides 2*d* on the upper surface thereof for guiding paper P widthwise. The guides 2*d* can be manually moved widthwise, i.e., in the lateral direction relative to the feeding direction.

A pair of a parting roller 3*b* and a retarding roller 3*c* for preventing overlap feeding of the paper P is disposed on the downstream side of the feeding roller 3*a* which picks up and feeds one sheet of paper P mounted on the hopper 2*b* at a time. The feeding passage of the paper P extends from the pair of the rollers to the recovery tray 1*b*. The feeding passage of the paper P is provided with a plurality of stages of feeding rollers 3*d* for nipping and carrying the paper P, a first scanning sensor 3*e* for reading a document image on the upper surface of paper P, and a second scanning sensor 3*f* for reading a document image on the lower surface thereof. The single sheet of paper P picked up from the hopper 2*b* by the feeding roller 3*a* passes through the feeding passage, on which the document images thereon are read by the first sensor 3*e* and the second sensor 3*f*, thereafter the sheet of paper P is discharged onto the recovery tray 1*b*.

Figure 3A:
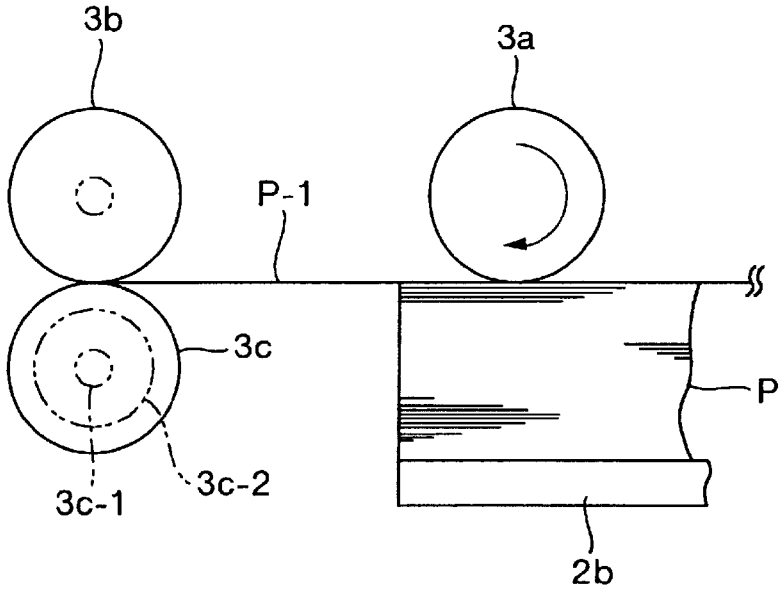
FIGS. 3A and 3B are detailed views showing an essential section of the sheet material feeding mechanism in accordance with the present invention.
Figure 3B:
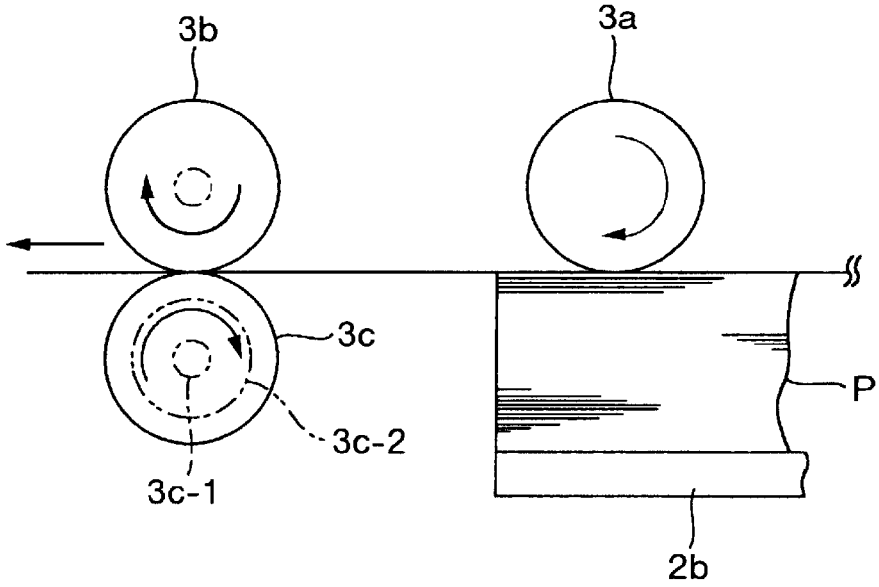

Referring to FIG. 3A and FIG. 3B, the feeding roller 3*a* is driven to rotate in the direction indicated by the arrow while a predetermined pressing force is constantly applies to the uppermost sheet of paper P-1 of the stack of paper P by the upward urging force by the hopper 2*b*. Then, the friction between the feeding roller 3*a* and the paper P-1 due to the pressing force causes the paper P-1 to be picked up and fed. The parting roller 3*b* is driven to rotate in the same direction same as that of the feeding roller 3*a*. The timing of starting the parting roller 3*b* is, however, delayed from the timing at which the rotation of the feeding roller 3*a* is started, that is, the rotation of the parting roller 3*b* is started upon completion of the feed of the uppermost one of the overlapping sheets of paper P which have been simultaneously fed.

Figure 11A:
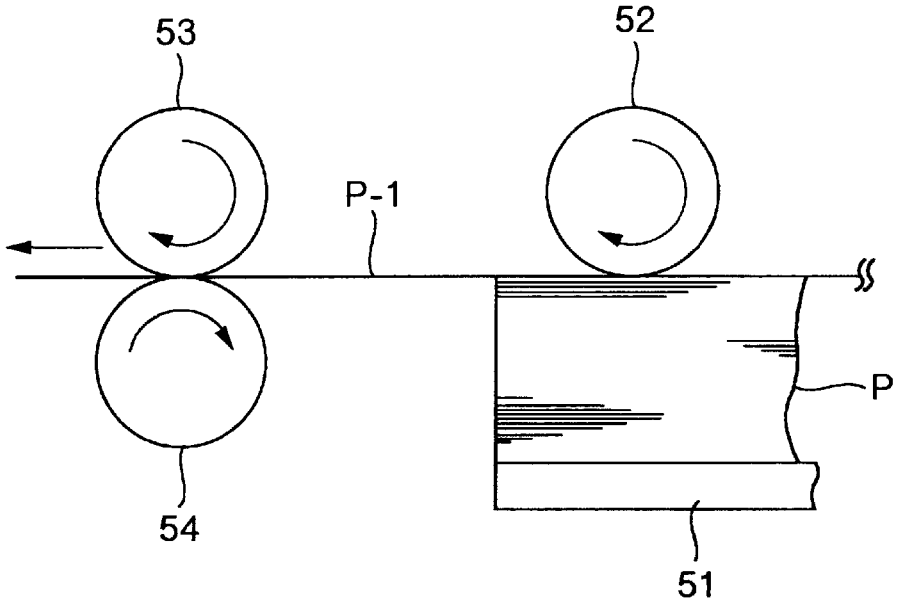
FIGS. 11A and 11B are schematic views showing a conventional paper feeding mechanism.
Figure 11B:
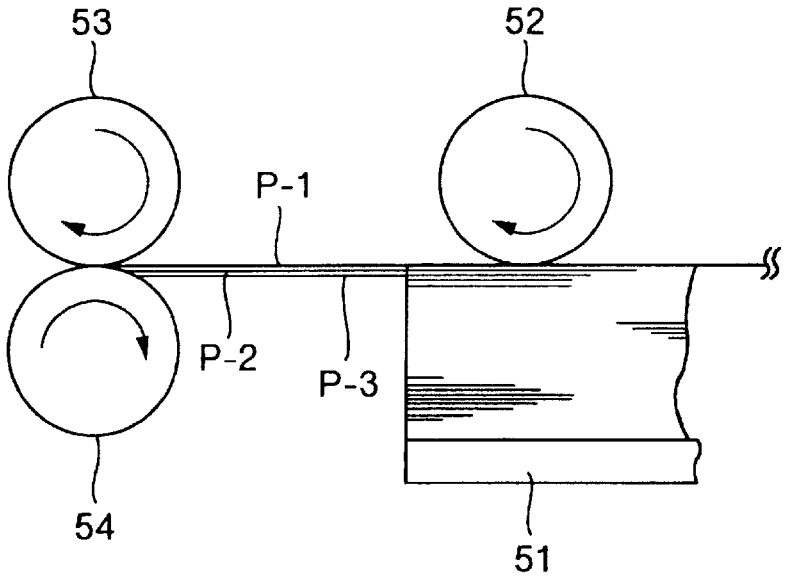

The retarding roller 3*c* is mounted via a torque limiter 3*c*-2 on a main shaft 3*c*-1 which is driven to rotate clockwise in FIG. 3B, as in the case of the conventional one shown in FIG. 11A and FIG. 11B. The main shaft 3*c*-1 is supported by a supporting member (not shown) which elastically urges the retarding roller 3*c* toward the parting roller 3*b*, so that the overlap feeding of the paper P is prevented by the above urging force and the function of the torque limiter 3*c*-2. The construction of the retarding roller 3*c* with the built-in torque limiter 3*c*-2 is well known in the field of the paper feeding mechanism in an image forming apparatus.

According to the present invention, the parting roller 3*b* and the retarding roller 3*c* are controlled so as to be driven to rotate after the feeding roller 3*a* starts to be driven to rotate for feeding the paper P. More specifically, as shown in FIG. 3A, after the feeding roller 3*a* starts to rotate and picks up sheet of paper P-1, the parting roller 3*b* and the retarding roller 3*c* remain still stopping. Then, as shown in FIG. 3B, the parting roller 3*b* and the retarding roller 3*c* are started at the moment the front edge of the single sheet of paper P-1 is nipped between the parting roller 3*b* and the retarding roller 3*c,* or very slightly later than the aforesaid moment. When the single sheet of paper P-1 is nipped between the parting roller 3*b* and the retarding roller 3*c,* the retarding roller 3*c* rotates in the opposite direction from the rotational direction of the main shaft 3*c*-1, that is, it rotates in the paper feeding direction, thereby it is possible to quickly feed out the sheet of paper P-1 to the feeding passage.

In the construction set forth above, when a control button 1*a*-1 on the control panel 1*a* is turned ON, the feeding roller 3*a* starts to rotate in the direction of the arrow shown in FIG. 2, and the parting roller 3*b* and the retarding roller 3*c* start to rotate at the timing described in conjunction with FIG. 3A and FIG. 3B. Furthermore, the feeding rollers 5*d* on its downstream side also start to rotate at the same timing. This causes the single sheet on the top of paper P loaded on the hopper 2*b* to be picked up by the feeding roller 3*a,* passed between the parting roller 3*b* and the retarding roller 3*c,* and fed to the feeding passage, as illustrated in FIG. 3B.

When a sheet of paper P is picked up by the feeding roller 3*a,* if the sheets of paper P firmly cling to each other, then a plurality of sheets are simultaneously fed to the parting roller 3*b* and the retarding roller 3*c,* as in the case of the conventional example shown in FIG. 11B. In the conventional structure, the parting roller 3*b* and the retarding roller 3*c* are constantly rotating when the feeding roller 3*a* is rotating; so that a plurality of sheets of paper simultaneously pass between the parting roller 3*b* and the retarding roller 3*c,* resulting in the overlap feeding. To prevent such overlap feeding, according to the present invention, the parting roller 3*b* and the retarding roller 3*c* are started at a timing later than that of the feeding roller 3*a* and at the moment the front edge of a sheet of paper P touches the nipping point between the parting roller 3*b* and the retarding roller 3*c*.

Figure 4A:
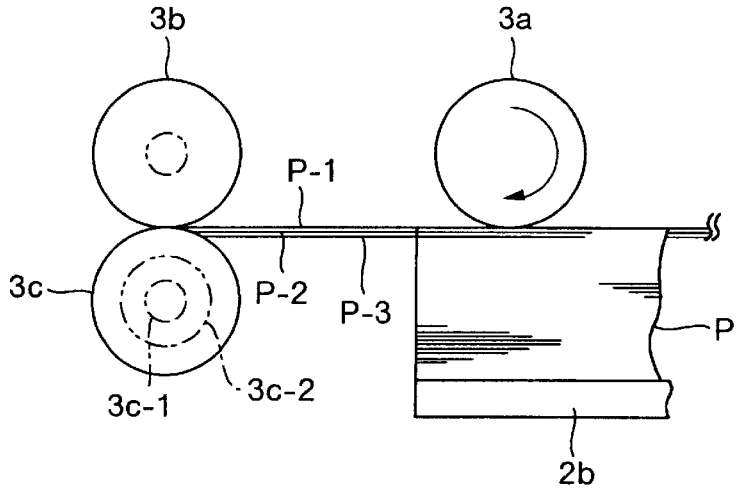
FIGS. 4A–4C are detailed views showing the essential section of the sheet material feeding mechanism in accordance with the present invention.
Figure 4B:
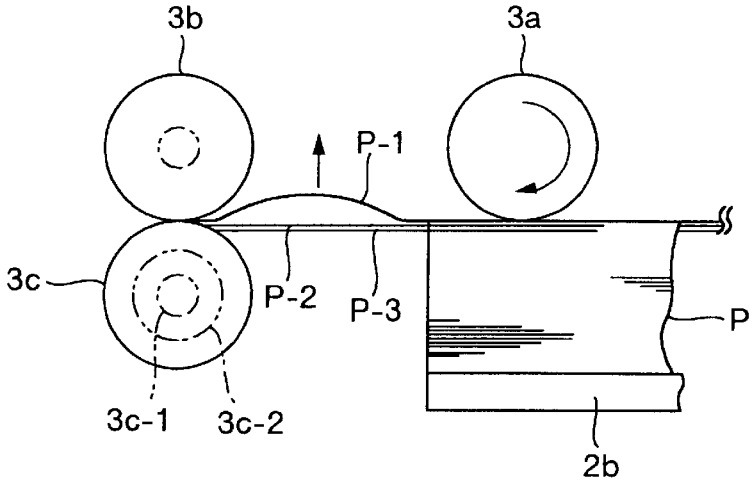
Figure 4C:
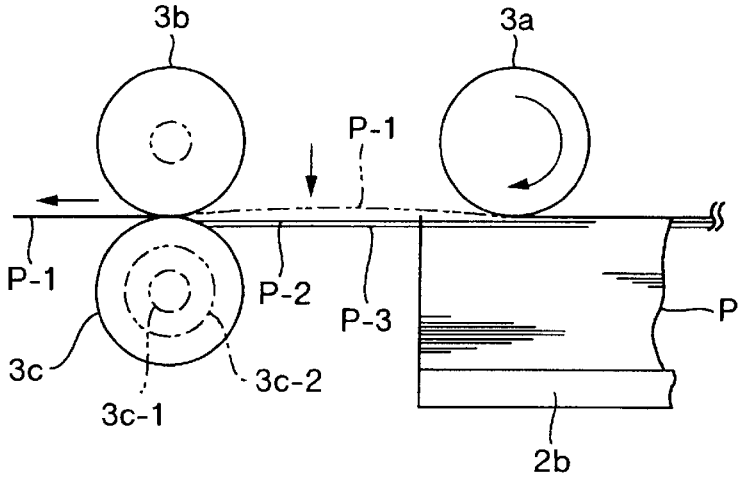

Referring now to FIG. 4A through FIG. 4C, if, for example, three sheets of paper P-1 through P-3 are simultaneously fed, while overlapping each other, to the parting roller 3*b* and the retarding roller 3*c,* the front edges of the sheets of paper P-1 through P-3 bump against the nipping portions or the peripheral surfaces of the parting roller 3*b* and the retarding roller 3*c* which are still at rest, thus blocking the advance of the front edges. The feeding roller 3*a,* however, continues to rotate, so that the uppermost sheet of paper P-1 in contact with the peripheral surface of the feeding roller 3*a* is advanced while leaving the lower sheets of paper P-2 and P-3 behind. Hence, as shown in FIG. 4B, the sheet of paper P-1 is deflected while producing a gap between the sheets of paper P-1 and P-2 to form an air layer thereunder. The parting roller 3*b* and the retarding roller 3*c* are driven to rotate with a time lag so as to cause the sheet of paper P-1 to deform and to form the air layer between the sheets of paper P-1 and P-2. As a result, only the uppermost sheet of paper P-1 which becomes free from the restraint by the friction between the sheets of paper P-1 and P-2 is readily nipped by the parting roller 3*b* and the retarding roller 3*c*. The deformed sheet of paper P-1 is fed by the nipping, and thereafter is gradually restored in its original flatness as it is further fed, as illustrated in FIG. 4C.

Thus, even if the overlapping sheets of paper P are simultaneously fed in a multiple layers condition to the parting roller 3*b* and the retarding roller 3*c,* the sheet of paper P-1 is parted from the lower two sheets of paper P-2 and P-3 during the period in which the feeding roller 3*a* continues to rotate while the parting roller 3*b* remains still stopping, so that it is enabled to feed only the sheet of paper P-1 to the downstream feeding passage. Therefore, even if the overlap feeding of the paper P takes place when picking up from the hopper 2*b,* only the uppermost sheet of paper P-1 is fed by the parting roller 3*b* and the retarding roller 3*c,* so as to prevent the overlap feeding of the paper P in the feeding passage including the reader.

The feeding roller 3*a,* the parting roller 3*b* and the retarding roller 3*c* interrupt their rotation the moment the sheet of paper P-1 is nipped by a pair of the feeding rollers 3*d* in the first stage. When the next sheet of paper P-2 is fed, the parting roller 3*b* and the retarding roller 3*c* are started at the timing later than the start of the feeding roller 3*a*. In this case, the feeding force is also applied to the sheet of paper P-2 until the sheet of paper P-2 reaches the nipping portions of the parting roller 3*b* and the retarding roller 3*c*. This causes the sheet of paper P-2 to deform with respect to the sheet of paper P-3. Accordingly, as the same manner with the case of the feed of the sheet of paper P-1, only the sheet of paper P-2 can be fed while leaving the sheet of paper P-3 thereunder behind. In the subsequent steps, the feeding roller 3*a* continues to rotate, while the parting roller 3*b* and the retarding roller 3*c* are driven to rotate with the time lag. By this arrangement, it is possible to feed the one sheet of paper P at a time in order from the uppermost of the sheets if the overlap feeding of the paper P from the hopper 2*b* takes place.

In the above description, the retarding roller 3*c* is driven to rotate at the same time as the parting roller 3*b*. Alternatively, however, only the parting roller 3*b* may be driven to rotate. In this case, the retarding roller 3*c* may be arranged so that it prevents the overlap feeding using the torque limiter 3*c*-2.

According to one aspect of the present invention, even if a plurality of sheet materials such as paper loaded on a hopper or a tray are picked up by a feeding roller, the overlap feeding of the sheet materials can be corrected by the parting roller by utilizing the time lag of the start of the rotation between the downstream parting roller and the retarding roller, so that the overlap feeding is prevented. Hence, only the uppermost sheet material can be fed to an image processing apparatus. Therefore, an image can be formed or read smoothly, and the apparatus does not become complicated because the present invention can be achieved simply by adding the control of the drive based on the time lag between the feeding roller and the parting roller to an existing apparatus.

Another embodiment in accordance with the present invention will now be described, by taking an example of an image scanner adapted to automatically feed documents and read the images thereon.

Figure 5:
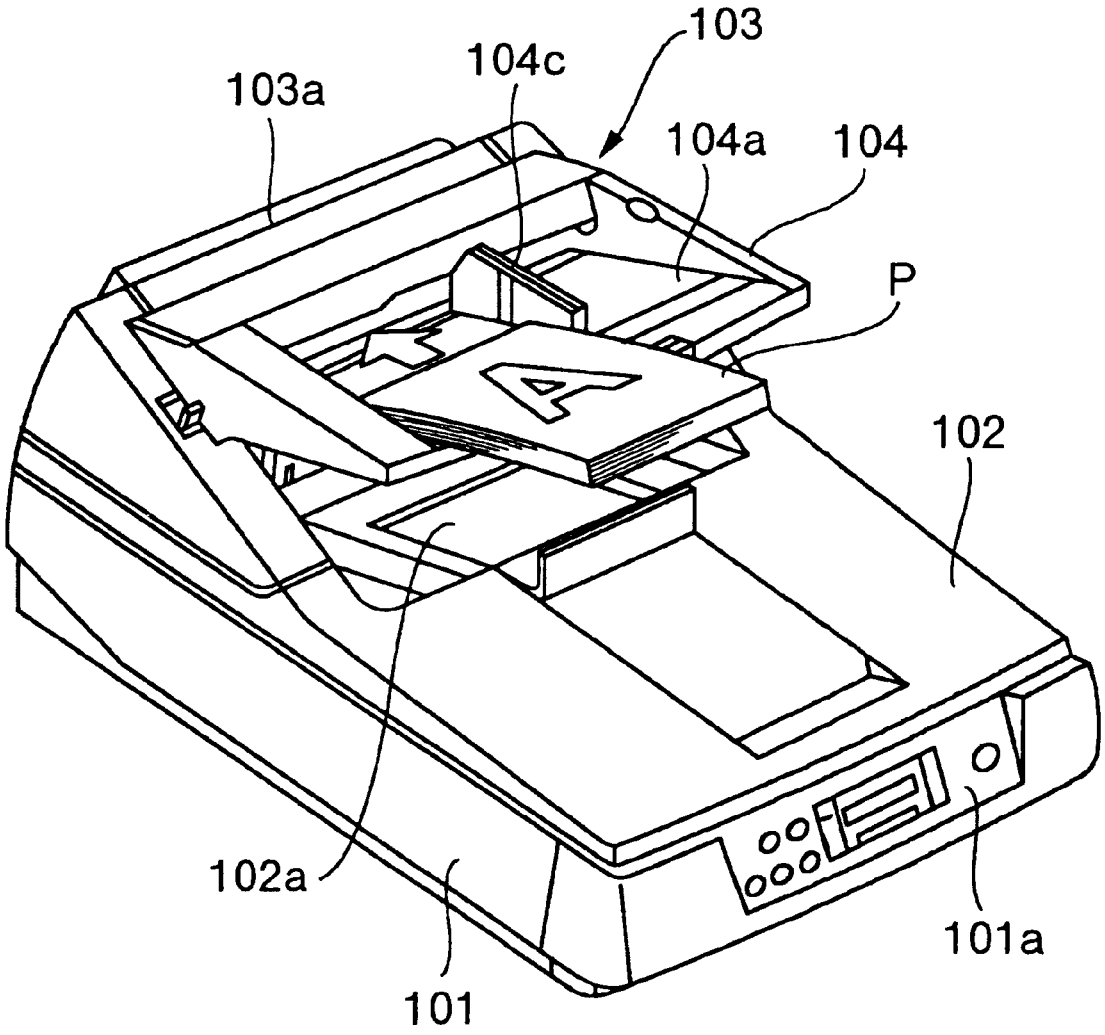
FIG. 5 is a schematic perspective view of an image scanner equipped with a overlap feeding detection mechanism in accordance with the present invention.
Figure 6:
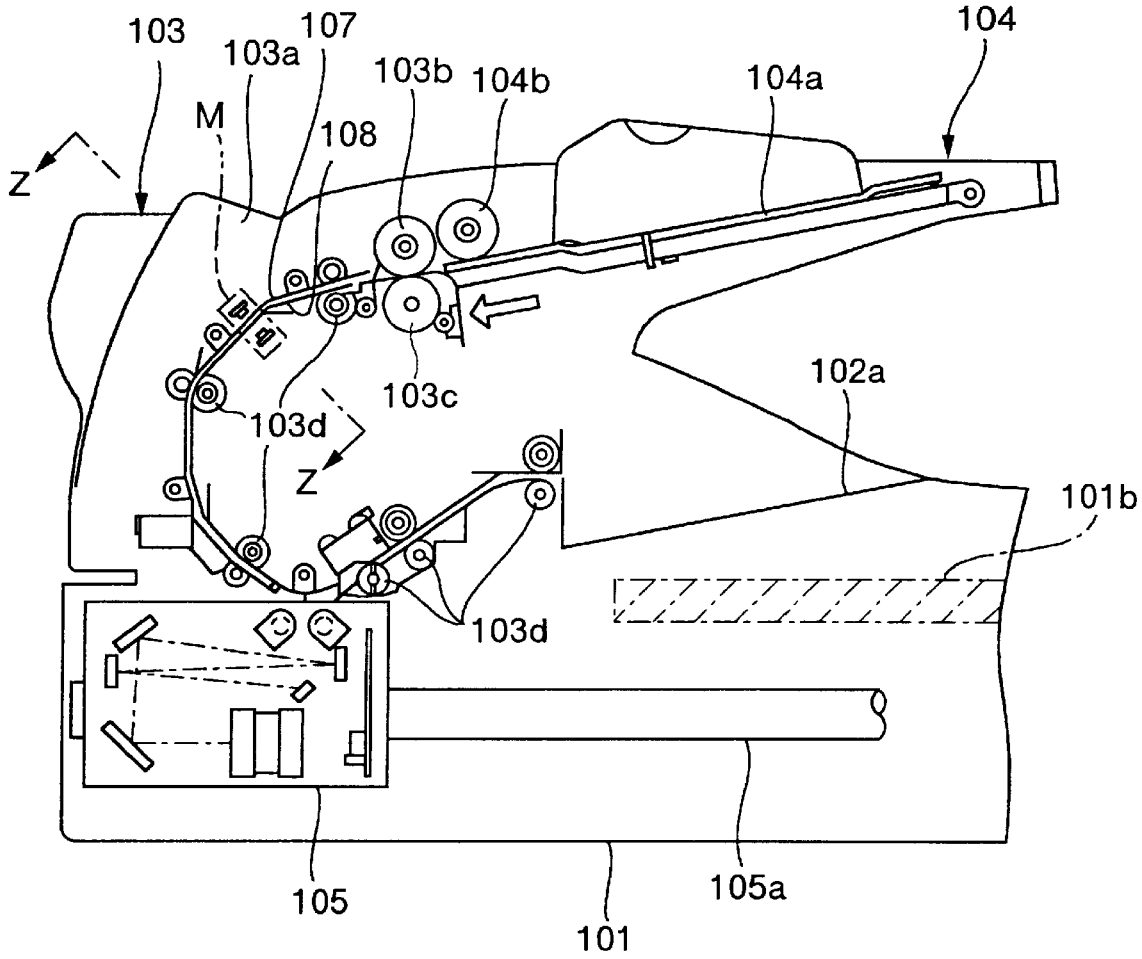
FIG. 6 is a schematic longitudinal sectional view of a paper feeding mechanism equipped with the overlap feeding detection mechanism in accordance with the present invention.

Referring to FIG. 5 and FIG. 6, the image scanner is constituted by a main unit 101 incorporating an optical scanning module, which will be discussed hereinafter, a document cover 102 installed on the top surface of the main body 101 such that the cover 102 can be opened and closed, and an automatic paper feeder 103 on which sheets of document paper are loaded and which automatically feeds the sheets of document paper.

The main unit 101 is provided with a control panel 101*a* on its front surface, and also includes a controller (not shown) for controlling all operating devices. Furthermore, on the top surface of the main unit 101, there are an image reader 101*b* using a transparent glass pane for reading a document on a sheet of paper, the document cover 102 which has a pivot located at the back of the main unit 101 and can be opened and closed, and the automatic feeder 103 which can be opened and closed in relation to the document cover 102. Moreover, the image reader 1*b* is used for reading an image on a large-sized sheet of paper which is manually set. The sheets of paper P of the A4 size or the like, as shown in FIG. 5, are fed from the automatic paper feeder 103 and discharged onto a recovery tray 102*a* on the document cover 102 after the images thereon have been read.

The automatic paper feeder 103 is constructed by a housing 103*a* and a hopper unit 104 mounted on the upper edge side of the housing 103*a*. The hopper unit 104 is equipped with a paper feeding hopper 104*a* on which paper P is loaded, as shown in FIG. 5, and a feeding roller 104*b* which picks up and draws out the paper P, as shown in FIG. 6. In the housing 103*a*, a pair of a parting roller 103*b* and a retarding roller 103*c* for preventing overlap feeding are disposed at a position on the immediate downstream side of the feeding roller 104*b*, and a feeding passage which detours above the vicinity of the upper surface of the main unit 101 and extends to the recovery tray 102*a* of the document cover 102 is formed. A plurality of feeding rollers 103*d* are provided along the feeding passage.

A scanning module 105 for reading the images on a sheet of paper P fed by the automatic paper feeder 103 is provided inside the main unit 101. The scanning module 105 includes a miniature optical image reading system using a CCD as is the case with a conventional image reader, and is of a carriage type which is mounted on and moves along a guide 105*a* extending from the vicinity of the control panel 1*a* on the front surface of the main unit 101 to the vicinity of the rear surface of the main unit 101.

The feeding passage extending from the automatic feeder 103 to the recovery tray 102*a* via the scanning module 105 is formed by two guide plates 107 and 108. These guide plates 107 and 108 are disposed so as to have a gap therebetween for allowing the paper P to pass therethrough, and have openings provided in portions where the feeding rollers 103*d* are installed so as to enable the feeding rollers 103*d* to nip the paper P for feeding it. Furthermore, an overlap feeding detection mechanism M for detecting the overlap feeding of the paper P is disposed on the downstream side of the pair of the parting roller 103*b* and the retarding roller 103*c*.

Figure 7A:
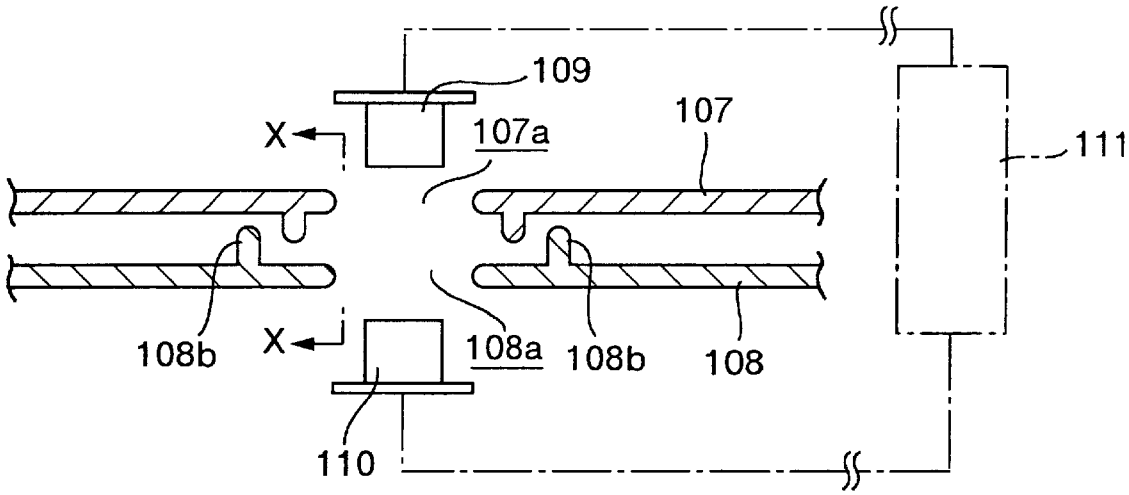
FIG. 7A is a schematic longitudinal sectional view showing the overlap feeding detection mechanism taken from the line Z—Z in FIG. 6.
Figure 7B:
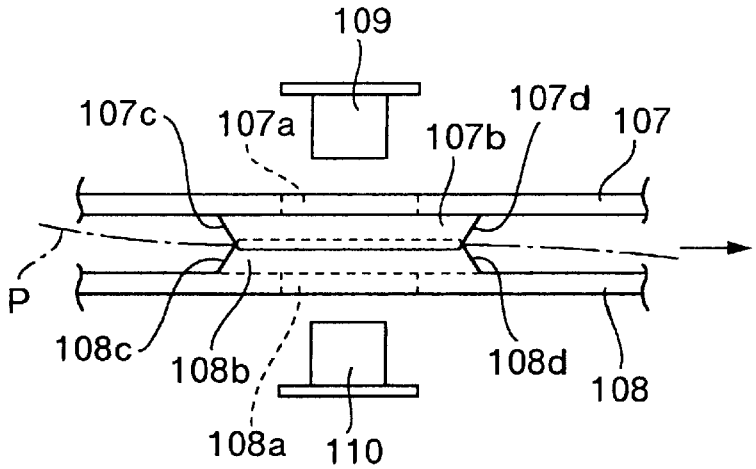
FIG. 7B is another view taken from the line X—X in FIG. 7A.
Figure 12A:
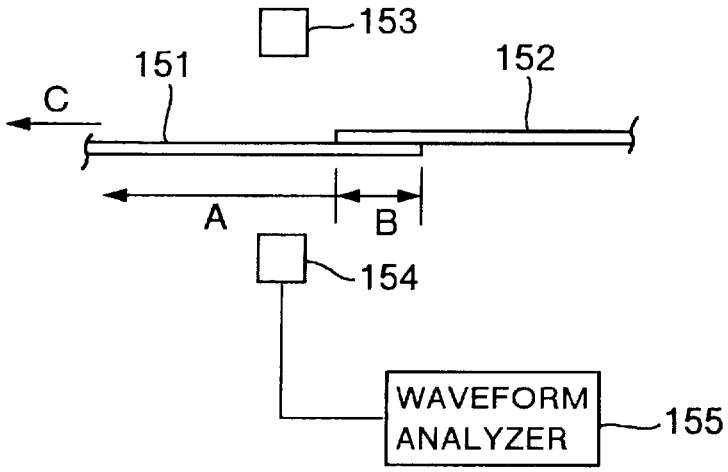
FIG. 12A is a schematic view showing a conventional overlap feeding detection mechanism.
Figure 12B:
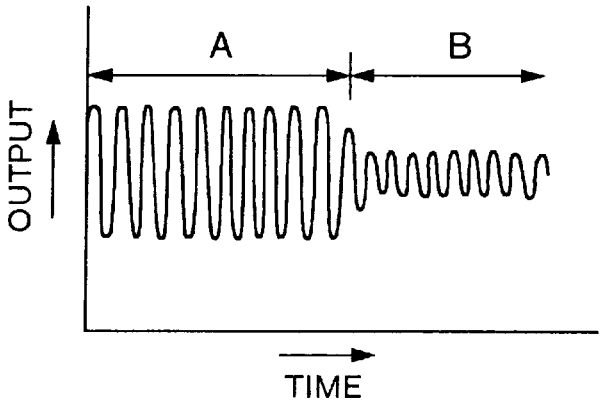
FIG. 12B is a diagram showing an output waveform on a receiving side in the conventional overlap feeding detection mechanism.

Referring now to FIG. 7A and FIG. 7B, the guide plates 107 and 108 have circular openings 107*a* and 108*a* respectively, which are coaxially formed at the center in the width direction of the guide plates 107 and 108 (in the lateral direction in the drawings). An ultrasonic transmitter 109 and an ultrasonic receiver 110 are disposed so as to correspond to the openings 107*a* and 108*a*, respectively. The ultrasonic transmitter 109 and the ultrasonic receiver 110 have the same configurations and functions as those of the conventional art shown in FIG. 12A. The overlap feeding of the sheets of paper P is detected through an output voltage of a waveform analyzer 111 which receives output signals from the ultrasonic receiver 110.

The upper and lower guide plates 107 and 108 which constitute the feeding passage of the paper P are provided with a pair of bending correction ribs 107*b* and a pair of bending correction ribs 108*b* respectively, as shown in FIG. 7A and FIG. 7B. The ribs 108*b* of the guide plate 108 disposed on the lower side are arranged so that they are parallel to each other at the positions symmetrical with respect to the center of the opening 108*a*, as shown by the solid line in FIG. 8A, and are formed along the paper feeding direction with the same height, as indicated by the arrow in the drawing. Each of the bending correction ribs 108*b* has arcuate profile surfaces 108*c* and 108*d* at one end thereof from which the paper P enters and at the other end thereof from which the paper P leaves, respectively. Furthermore, the bending correction ribs 107*b* of the guide plate 107 disposed on the upper side are arranged so that they are parallel to each other at the positions symmetrical with respect to the center of the opening 107*a*, as shown in FIG. 7A. The pair of bending correction ribs 107*b* is positioned slightly closer to the opening 107*a* than the bending correction ribs 108*b* of the guide plate 108 disposed on the lower side as shown in FIG. 7A, and has arcuate profile surfaces 107*c* and 107*d* at one end thereof from which the paper P enters and at the other end thereof from which the paper P leaves respectively, as shown in FIG. 8B.

The projecting height of the bending correction ribs 107*b* and 108*b* are the same, and slightly longer than a half of the distance between the opposing surfaces of the upper and lower guide plates 107 and 108. In this arrangement, the guide plates 107 and 108 are disposed in combination so as to provide a predetermined gap therebetween, so that the positions of the bottom and top ends of the bending correction ribs 107*b* and 108*b* respectively are vertically staggered.

Figure 8A:
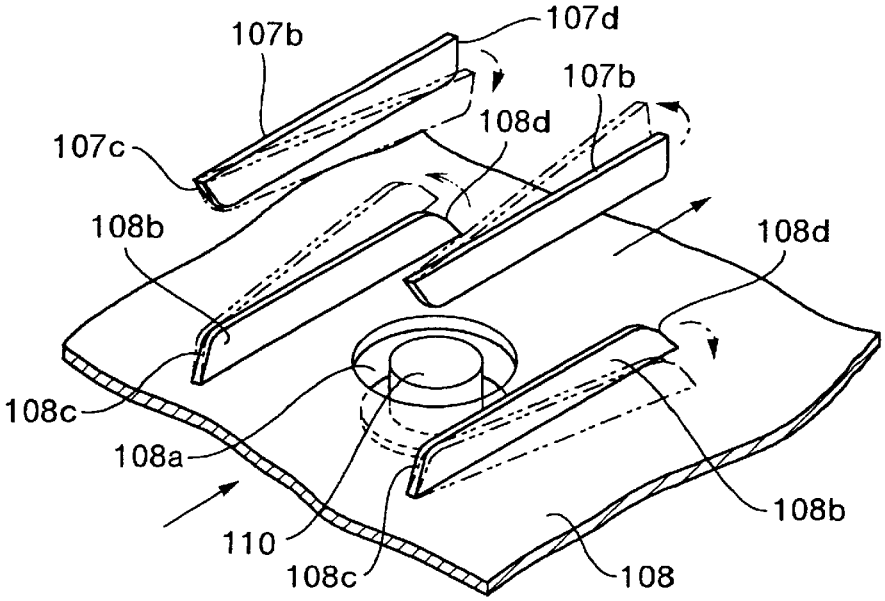
FIG. 8A is a schematic perspective view of an example in which a pair of bending correction ribs is disposed so that the ribs are parallel to each other.
Figure 8B:
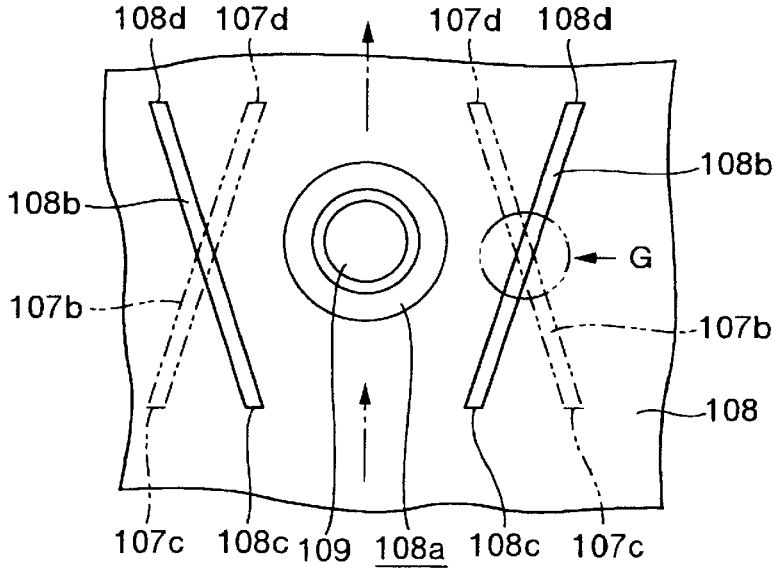
FIG. 8B is a top plan view of an essential section illustrating an example in which the orientations of a pair of bending correction ribs are different.
Figure 8C:
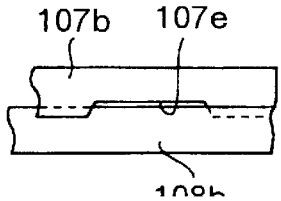
FIG. 8C is a schematic view showing a portion circled by a two-dot chain line in FIG. 8B, observed from the direction indicated by G.

The pairs of the bending correction ribs 107*b* and 108*b* may alternatively be arranged as shown in FIG. 8A rather than arranging them parallel across the openings 107*a* and 108*a*. More specifically, the pair of bending correction ribs 108*b* of the lower guide plate 108 is arranged such that the ribs are gradually apart from each other in the paper feeding direction, as indicated by the one-dot chain lines in the drawing. On the other hand, the pair of bending correction ribs 107*b* of the upper guide plate 107 may be arranged such that the gap therebetween at the end where paper P is received is larger than the gap between the bending correction ribs 108*b* of the lower guide plates 108, and the gap gradually narrows toward the end where the paper leaves. In this arrangement, the upper and lower bending correction ribs 107*b* and 108*b* substantially intersect with each other in an X shape, as shown in the drawing. Importantly, the intersecting sections of the bending correction ribs 107*b* and 108*b* do not interfere to allow the paper P to pass. For this purpose, as illustrated in FIG. 8C (the schematic view showing the portion circled by the two-dot chain line, as observed from the direction indicated by arrow G in FIG. 8B), a cutout 107*e* is provided at the bottom end of the bending correction rib 107*b*. By being provided with the cutouts 107*e*, it is possible to prevent the intersecting portions of the bending correction ribs 107*b* and 108*b* from interfering with each other even when the upper and lower ends of the bending correction ribs 107*b* and 108*b* are vertically staggered. Hence, the paper P slips through the cutouts 107*e* when being fed so as to prevent paper jams. The cutouts may alternatively be provided on the upper ends of the lower bending correction ribs 108*b*, or further alternatively, the cutouts may be provided in both bending correction ribs 107*b* and 108*b*.

The guide plates 107 and 108 are primarily made of a metal plate, so that the surfaces of the bending correction ribs 107*b* and 108*b* formed integrally with the guide plates 107 and 108 respectively have small frictional coefficients. However, the downward curved deformation of the paper P can be enhanced by providing at least the bending correction rib 108*b* of the lower guide plate 108 with a coarse surface to increase the frictional coefficient. The bending correction rib 108*b* can be provided with a coarse surface by knurling at least the upper end surface thereof or attaching a friction pad thereto.

In the construction described above, when the paper P on the paper feeding hopper 104*a* is automatically fed by using the automatic paper feeder 103, the paper P is drawn out by the feeding roller 104*b*. The parting roller 103*b* and the retarding roller 103*c* prevent two or more sheets of paper P from being fed in an overlapping condition, so that the single sheet of paper P is passed through the guide plates 107 and 108 constituting the feeding passage, and conveyed by the feeding rollers 103*d*. Then, the document image on the sheet of paper P is read by the scanning module 105, and the sheet of paper P is discharged onto the recovery tray 102*a*.

Figure 9:
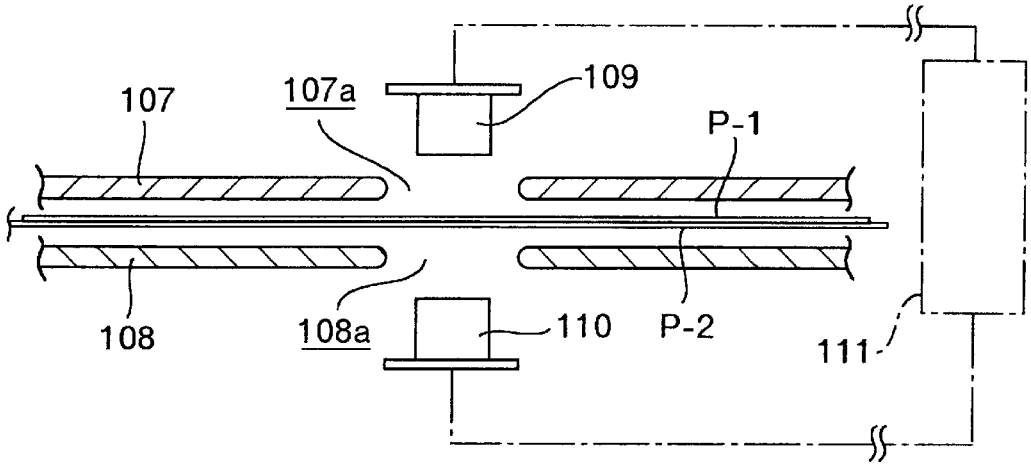
FIG. 9 is a schematic longitudinal sectional view showing an essential section illustrating the overlap feeding taking place when guide plates provided with no bending correction ribs are used.

There are cases where the overlap feeding of the paper P cannot be prevented even by the parting roller 103*b* and retarding roller 103*c*. In the case of such overlap feeding of the paper P, two sheets of paper P-1 and P-2 reach the overlap feeding detection mechanism M, for example in a condition in which these two sheets adhere to each other. The guide plates 107 and 108 are disposed so as to have an appropriate gap provided therebetween to permit the paper P to pass therethrough; hence, if the bending correction ribs 107*b* and 108*b* are not provided, the overlapping two sheets of paper P-1 and P-2 slip through an ultrasonic transmitter 109 and an ultrasonic receiver 110 as shown in FIG. 9. At this time, as previously discussed in relation to the prior art, if the sheets of paper P-1 and P-2 tightly cling to each other with almost no air layer therebetween, the overlap feeding of the sheets P-1 and P-2 will be overlooked even by using the ultrasonic transmitter 109 and the ultrasonic receiver 110.

Figure 10:
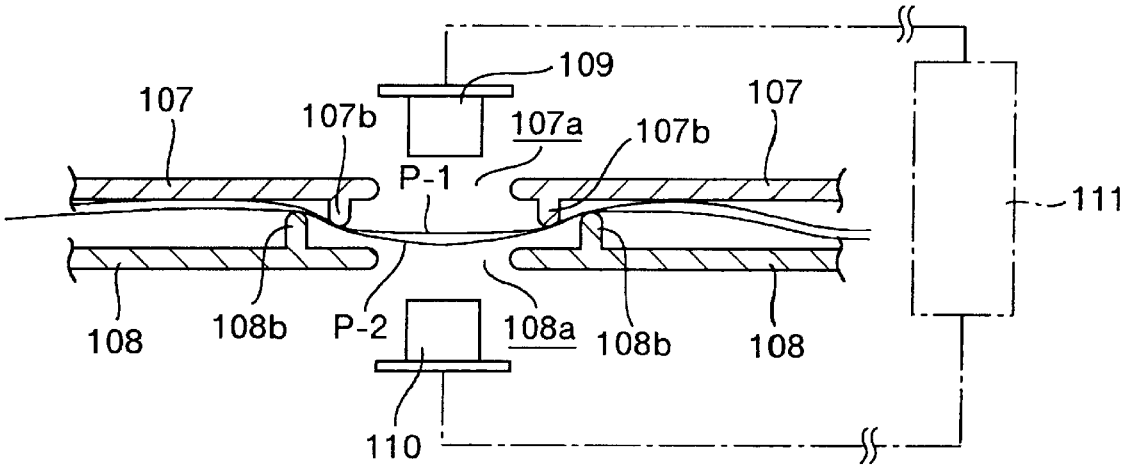
FIG. 10 is a schematic longitudinal sectional view showing a condition in which an air layer is formed between sheets of paper in the overlap feeding detection mechanism in accordance with the present invention, observed from a feeding direction.

To solve the above problem, the guide plates 107 and 108 are provided with the pairs of bending correction ribs 107*b* and 108*b* which have such configurations and positional relationship as shown in FIG. 7A and FIG. 7B. By this arrangement, when the sheets of paper P-1 and P-2 pass through the pairs of the bending correction ribs 107*b* and 108*b*, a gap can be provided therebetween. More specifically, as illustrated in FIG. 10, the sheets of paper P-1 and P-2 are pushed up by the bending correction rib 108*b* of the lower guide plate 108, while the sheets are pushed down by the bending correction rib 107*b* of the upper guide plate 107. As shown in FIG. 7B, since the upper and lower ends of the upper and lower bending correction ribs 107*b* and 108*b* are vertically staggered, the sheets of paper P-1 and P-2 supported by the upper end of the bending correction rib 108*b* are pushed down and curved by the bending correction rib 107*b* shifted toward the center side of the openings 107*a* and 108*a*. Meanwhile, the feeding force is uninterruptedly applied to the sheets of paper P-1 and P-2, so that the sheets keep on moving, the sheet of paper P-1 is in contact with the lower end of the bending correction rib 107*b*, and the sheet of paper P-2 is in contact with the upper end of the bending correction rib 108*b*.

Thus, the sheets of paper P-1 and P-2 are simultaneously subjected to the bending force and frictional resistance applied by the bending correction ribs 107*b* and 108*b*. As a result, the sheet of paper P-1 between the pair of the bending correction ribs 107*b* and the sheet of paper P-2 between the pair of the bending correction ribs 108*b* are deformed downward respectively. This means that, the sheets of paper P-1 and P-2 which firmly cling to each other as illustrated in FIG. 9 are forcibly deformed downward in the curved shape by the bending correction ribs 107*b* and 108*b* so as to produce a slight difference in the curved deformation amount between the two sheets. This leads to the formation of a gap between the sheets of paper P-1 and P-2 and permits an air layer to be interposed therebetween as shown in FIG. 10.

Thus, the overlapping sheets of paper P-1 and P-2 turn into a laminate having the air layer gap. When the gap portion passes between the ultrasonic transmitter 109 and the ultrasonic receiver 110, the presence of the air layer permits reliable detection of overlap feeding. Therefore, even if the sheets of paper P-1 and P-2 firmly adhere to one another or are thin, the overlap feeding will not be overlooked, thereby highly accurate detection of the overlap feeding is achieved.

Even if the air layer between the sheets of paper P-1 and P-2 is extremely thin, the attenuation of the output waveform caused between the ultrasonic transmitter 109 and the ultrasonic receiver 110 will be adequately effective for assuring the detection of overlap feeding. This means that the difference in heights of the staggered upper and lower ends of the bending correction ribs 107*b* and 108*b* may be small, and thus the paper P will not develop the undue curved deformation. Hence, the paper P immediately restores its original flatness after passing through the bending correction ribs 107*b* and 108*b*, so as to permit the documents to be read free from distortion or the like when the image of the document is read by the scanning module 105 at the downstream side from the overlap feeding detection mechanism M.

In this case, in place of the positional relationship between the pairs of the bending correction ribs 107*b* and 108*b* which are arranged in parallel to one another, the pairs of ribs 107*b* and 108*b* may be arranged as illustrated in FIG. 8B to effectively create a gap between the sheets of paper P-1 and P-2. To be more specific, the sheet of paper P-1 is subjected to the resistance produced by the pair of bending correction ribs 107*b* having a distance narrowing toward the feeding direction, while the sheet of paper P-2 is subjected to the resistance produced by the pair of bending correction ribs 108*b* having a distance diverging toward the feeding direction. Thus, by applying the resistance to the two sheets of paper P-1 and P-2 in different manners, the sheets of paper P-1 and P-2 can be curved to securely produce a gap, namely to form an air layer therebetween.

Although the bending correction ribs 108*b* of the lower guide plate 108 may be parallel as shown in FIG. 8A, or not be parallel as sown in FIG. 8B, the friction coefficient of the upper end surfaces thereof is preferably set to a higher value as previously mentioned. By setting the friction coefficient of the bending correction ribs 108*b* to a higher value than that of the upper bending correction ribs 107*b*, the resistance applied to the sheet of paper P-2 becomes higher, so that it becomes easier for the sheet of paper P-2 to be deformed and curved. This allows the gap to be formed between the two sheets without the need for deforming the upper sheet of paper P-1. Hence, although the bending correction ribs 107*b* require a certain length, the bending correction ribs 108*b* having higher friction resistance can be made shorter, thereby making it possible to curvedly deform the sheet of paper P-2 sufficiently. As a result, the time during which the sheets of paper P-1 and P-2 are subjected to the bending load can be shortened so as to allow quicker recovery of the sheets. This allows satisfactory image reading by the scanning module 105 to be maintained.

In this embodiment, although a single pair of the bending correction ribs 107*b* and a single pair of the bending correction ribs 108*b* are provided, however, the number of the bending correction ribs 107*b* and 1088 is not limited thereto, thus any number of the bending correction ribs 107*b* and 108*b* may be provided as long as a gap is formed between the sheets of paper P-1 and P-2 at the portion including the ultrasonic transmission passage from the ultrasonic transmitter 109 to the ultrasonic receiver 110.

According to the present invention, in the detection of the overlap feeding of sheet materials performed by an ultrasonic transmitting means and an ultrasonic receiving means, the operation is performed to form an air layer between the sheet materials fed in the overlapping condition, so that the overlap feeding of firmly clinging sheet materials is not missed to permit highly accurate detection of the overlap feeding to be achieved. Moreover, even when the sheet materials are thin, it is possible to realize the highly accurate detection of overlap feeding since an air layer is formed in this case, and thus, the present invention can be ideally applied to a variety of types of image reading or image forming apparatuses which handle numerous different types of sheet materials.

What is claimed is:

1. A sheet material feeding mechanism of an image processing apparatus for feeding a sheet material from a stack of sheet materials mounted on a hopper or a tray to an image processing system, the sheet feeding mechanism comprising:

an overlap feeding detection mechanism and a pair of guide plates disposed on upper and lower sides of a sheet material feeding line, the overlap feeding detection mechanism including (a) an ultrasonic transmitting device for transmitting an ultrasonic wave toward a sheet material on the sheet material feeding line, and (b) an ultrasonic receiving device opposite to the ultrasonic transmitting device across the sheet material feeding line for receiving the ultrasonic wave which has passed through the sheet material and been attenuated thereby; and at least one pair of bending correction ribs provided on each guide plate, the ribs on each guide plate being opposite to each other across the ultrasonic transmitting passageway between the ultrasonic transmitting device and the ultrasonic receiving device, and being operable to urge the sheet material on the sheet material feeding line to deflect upward or downward in at least an area including the ultrasonic transmitting passageway so as to form a gap between the sheet materials being fed in a closely overlapped condition, wherein:

an output value of the attenuated ultrasonic wave is compared with a predetermined reference value to detect an overlap feeding of sheet materials, and the bending correction ribs disposed on the lower guide plate are disposed so that a distance therebetween gradually opens toward a sheet material feeding direction.

2. A sheet material feeding mechanism of an image processing apparatus for feeding a sheet material from a stack of sheet materials mounted on a hopper or a tray to an image processing system, the sheet feeding mechanism comprising:

an overlap feeding detection mechanism and a pair of guide plates disposed on upper and lower sides of a sheet material feeding line, the overlap feeding detection mechanism including (a) an ultrasonic transmitting device for transmitting an ultrasonic wave toward a sheet material on the sheet material feeding line, and (b) an ultrasonic receiving device opposite to the ultrasonic transmitting device across the sheet material feeding line for receiving the ultrasonic wave which has passed through the sheet material and been attenuated thereby; and at least one pair of bending correction ribs provided on each guide plate, the ribs on each guide plate being opposite to each other across the ultrasonic transmitting passageway between the ultrasonic transmitting device and the ultrasonic receiving device, and being operable to urge the sheet material on the sheet material feeding line to deflect upward or downward in at least an area including the ultrasonic transmitting passageway so as to form a gap between the sheet materials being fed in a closely overlapped condition, wherein:

an output value of the attenuated ultrasonic wave is compared with a predetermined reference value to detect an overlap feeding of sheet materials, and the bending correction ribs disposed on the upper guide plate are disposed so that a distance therebetween gradually closes toward a sheet material feeding direction.

3. A sheet material feeding mechanism of an image processing apparatus for feeding a sheet material from a stack of sheet materials mounted on a hopper or a tray to an image processing system, the sheet feeding mechanism comprising:

an overlap feeding detection mechanism and a pair of guide plates disposed on upper and lower sides of a sheet material feeding line, the overlap feeding detection mechanism including (a) an ultrasonic transmitting device for transmitting an ultrasonic wave toward a sheet material on the sheet material feeding line, and (b) an ultrasonic receiving device opposite to the ultrasonic transmitting device across the sheet material feeding line for receiving the ultrasonic wave which has passed through the sheet material and been attenuated thereby; and at least one pair of bending correction ribs provided on each guide plate, the ribs on each guide plate being opposite to each other across the ultrasonic transmitting passageway between the ultrasonic transmitting device and the ultrasonic receiving device, and being operable to urge the sheet material on the sheet material feeding line to deflect upward or downward in at least an area including the ultrasonic transmitting passageway so as to form a gap between the sheet materials being fed in a closely overlapped condition, wherein:

an output value of the attenuated ultrasonic wave is compared with a predetermined reference value to detect an overlap feeding of sheet materials, and a friction coefficient between the bending correction ribs disposed on the lower guide plate and the sheet material is larger than a friction coefficient between the bending correction ribs disposed on the upper guide plate and the sheet material.

* * * * *